US005463950A

United States Patent [19]

Cuir et al.

[11] Patent Number: 5,463,950

[45] Date of Patent: Nov. 7, 1995

[54] PRINTING MACHINE COMPRISING AT LEAST ONE CYLINDER WITH DOUBLE DISPLACEMENT

[76] Inventors: Jean-Pierre Cuir, 36 avenue de Brigode, 59650 Villeneuve D'Ascq; Gérard Cuir, 23 allée des Grands Champs, 59650 Villeneuve D'Ascq, both of France

[21] Appl. No.: 189,159

[22] Filed: Jan. 28, 1994

[30] Foreign Application Priority Data

Feb. 12, 1993 [FR] France ..... 93 01866

[51] Int. Cl.[6] ..... B41F 5/00

[52] U.S. Cl. ..... 101/329; 101/351; 101/425

[58] Field of Search ..... 101/329, 216, 101/219, 349, 350, 351, 352, 152, 157, 182, 479, 480, 425

[56] References Cited

U.S. PATENT DOCUMENTS

| | | | |
|---|---|---|---|
| 967,985 | 8/1910 | Sheldon | 101/351 |
| 2,506,011 | 5/1950 | Caulfield | 101/351 |
| 2,637,270 | 5/1953 | Bamford | 101/351 |
| 3,604,350 | 9/1971 | Rosenstadt | 101/351 |
| 4,729,309 | 3/1988 | Saterini | 101/182 |
| 5,125,339 | 6/1992 | Rogge | 101/352 |
| 5,142,978 | 9/1992 | Borel | 101/352 |

FOREIGN PATENT DOCUMENTS

| | | | |
|---|---|---|---|
| 581328 | 8/1959 | Canada | 101/352 |
| 2485990 | 1/1987 | France | B41F 5/24 |

*Primary Examiner*—Eugene H. Eickholt
*Attorney, Agent, or Firm*—Ladas & Parry

[57] ABSTRACT

The printing machine according to the invention comprises, for a given cylinder, first means for displacement from a first position corresponding to the work position to a second position, and second means for displacement from said second position to a third position; the shaft of said cylinder comprises an individual drive motor and toothed wheels at its two ends; the second displacement means comprise a set of two racks in which the toothed wheels may mesh, with the result that displacement of said cylinder from the second to the third position is obtained thanks to the rotation of the drive motor of the shaft of said cylinder. It may be question of a machine with automatic change of ink rollers, with at least two double-displacement ink rollers, or of a machine with automatic washing of the plate cylinder, with a double-displacement impression cylinder.

15 Claims, 9 Drawing Sheets

PRINTING MACHINE COMPRISING AT LEAST ONE CYLINDER WITH DOUBLE DISPLACEMENT

FIELD OF THE INVENTION

The present invention relates to a multi-cylinder printing machine and more particularly to a printing machine of the sheet—f e d flexographic type in which at least one cylinder, for example the ink roller or the impression cylinder is totally retractable by a double displacement of high amplitude.

BACKGROUND OF THE INVENTION

In all printing machines, the majority of the cylinders are provided with displacement members enabling the cylinders to be spaced apart from one another, particularly in the case of absence of sheets to be printed or of adjustment of the machine. Such spacing apart corresponds to a displacement of low amplitude.

A displacement of certain cylinders, of greater amplitude, is sometimes necessary, particularly when it is question of changing one cylinder by another.

A number of devices have already been proposed for rapidly and easily changing certain cylinders. It may be question of a device outside the printing machine, for example in the form of a robot, such as the one described in document EP 0 400 517. It may likewise be question of devices integrated in the printing machine. Such a device for automatically changing cylinders in a flexographic printer is described in document FR 2 485 990. This device aims more particularly at automatically changing the plate cylinders and ink rollers on a flexographic printer whose impression cylinder is common to a plurality of inking stations. It comprises gripping means adapted to effect a certain disengagement of the cylinders in height, said gripping means cooperating with tiltable runways intended to ensure a linear translation of the cylinders, moving by gravity over the runways until they reach a position where they are adapted to be taken by pulley blocks.

In Applicants' opinion, the device described in this document FR 2 485 990 presents a certain number of drawbacks. On the one hand, it is very complex from the production standpoint, employing a very large number of various mechanical members. In addition, it is not totally automatic, insofar as a manual intervention is necessary to release the cylinder which it is desired to change.

It is an object of the present invention to propose a printing machine equipped with a plurality of cylinders and which comprises displacement means for at least one of said cylinders, which overcomes the drawbacks set forth hereinabove.

SUMMARY OF THE INVENTION

This object is perfectly attained by the machine of the invention which is characterized in that it comprises, for a given cylinder, first means for displacement from a first position corresponding to the work position to a second position, and second means for displacement from said second position to a third position; moreover, as the shaft of said cylinder, with double displacement, comprises an individual drive motor and toothed wheels at its two ends, the second displacement means comprise a set of two racks in which said toothed wheels may mesh, with the result that displacement of said cylinder from the second to the third position is obtained thanks to the rotation of said drive motor.

It will be understood that, according to the invention, the individual drive motor of the double-displacement cylinder remains fast with said cylinder during the two successive displacements thereof. It is question, in particular, of an electronic servo-control motor, of the brushless type.

Of course, it had already been proposed to equip cylinders of a printing machine with individual drive motors, particularly in document FR 2 553 032. However, such a motor had never been used for effecting a displacement of the cylinder during retraction thereof with respect to its work position, as is the case in the present invention.

Each end of the shaft of the double-displacement cylinder is preferably fast with a slide block and the first displacement means comprise a first set of two slideways defining the path of said slide blocks between the first and the second position and are adapted to move the two slide blocks in said slideways simultaneously.

According to this particular embodiment, the first displacement of the cylinder is a linear displacement between the first and the second position. Being question of a sheet—fed flexographic printing machine, this first linear displacement is a vertical displacement, both for the ink roller and for the impression cylinder.

According to a first variant, each slide block comprises a rack and the first displacement means comprise a motor driving a pinion which is adapted to Mesh on said rack.

According to a second variant, the two slide blocks comprise a notch and the first displacement means comprise a motor driving two vertical ballscrews, each screw having a length at least equal to the distance between the first and the second position and being adapted to pass in the notch, with the result that the nut of the ballscrew bears a slide block between the first and the second position and the screw may leave the notch and be disengaged from the slide block between the second and the third position.

The ink roller of the printing machine according to the invention may advantageously be changed automatically. In that case, the machine comprises at least two screened ink rollers with double displacement, one being in the fourth, so-called storage position whilst the other is in the first, so-called work position; moreover, it comprises third means for displacing said rollers from the fourth to a second position, said displacement being in the same direction, that of displacement from the second to the third position. The ink roller is changed by actuating the first, second and third displacement means so that the ink roller which, in the work position, passes to the second then to the third position, and the roller which is in the fourth so-called storage position passes to the second then to the first position.

The plate cylinder of the printing machine is advantageously automatically washed. In that case, it comprises an impression cylinder with double-displacement, placed in work position beneath the plate cylinder, a mobile device for washing the plate cylinder and means for displacing said washing device, adapted to bring it near the plate cylinder when the impression cylinder has passed from the first to the third position.

When the impression cylinder is in work position, the mobile washing device is preferably placed in a housing which is located near the second position; the means for displacement of said washing device in that case comprise the first means for displacement of the impression cylinder. In that case, it is the same displacement means which effect both the retraction of the impression cylinder between the first and second position and which effect positioning of the mobile washing device from its housing to its location near and beneath the plate cylinder.

The printing machine according to the invention is advantageously automatically retractable from the impression cylinder and the system for transferring the material to be printed, fast with said impression cylinder. In that case, the machine also comprises support rods on which the transfer system abuts and pivots on itself during passage of the impression cylinder from the first to the third position.

BRIEF DESCRIPTION OF THE DRAWINGS

The invention will be more readily understood on reading the following description of two embodiments of a sheet—fed flexographic printing machine incorporating a cylinder with double displacement: the first embodiment concerns the automatic change of the ink roller, and the second embodiment concerns simultaneously the retraction of the assembly constituted by the impression cylinder and the sheet transfer system supplying the machine, as well as the automatic washing of the plate cylinder. These two embodiments are illustrated in the accompanying drawings, in which.

DESCRIPTION OF PREFERRED EMBODIMENTS

Figure 1:
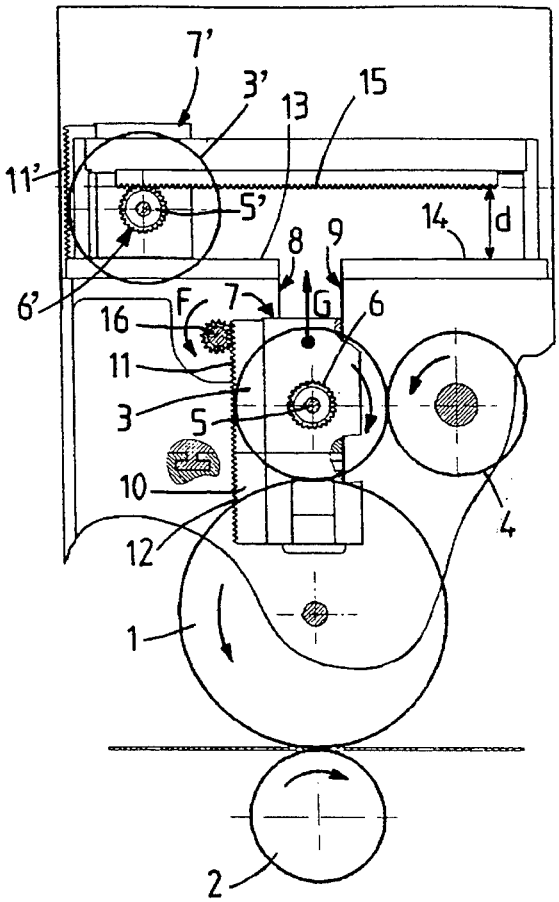
FIG. 1 is a side view of the printing machine with two automatically changed Screened ink rollers.

Referring now to the drawings, the printing machine which will be described hereinbelow is a sheet—fed flexographic printer in which the fixed plate cylinder 1 occupies a central position, whilst the impression cylinder 2 is located below the plate cylinder 1 and the screened ink roller 3 thereabove. However, this choice does not limit, but simply illustrates the invention.

The screened ink roller is the cylinder which supplies to the plate cylinder the desired dose of ink. It comprises on its surface a multitude of cells. The ink deposited on the screened ink roller 3 is scraped thanks to a rubber roller 4 or possibly by a doctor blade in order to leave on its surface a quantity of ink corresponding to the volume of its cells. This ink is then transferred onto the plate cylinder 1, against which the screened ink roller 3 is applied. The sheet to be printed passes between the plate cylinder 1 and the impression cylinder 2 so that the ink deposited on the plate is applied on said sheet.

In order to obtain prints of good quality, it may be necessary to modify the quantity of ink supplied to the plate as a function of the type of print, for example plane printing or text in fine characters, or of cardboard type for example kraft or coated cardboard. Such a modification of the quantity of ink can be effected only by changing the screened ink roller. The printing machine illustrated in FIG. 1 shows the different elements for automatically changing the screened ink roller.

For simplification purposes, only the change between two screened ink rollers 3 and 3' have been shown and will be described. In FIG. 1, the first screened ink roller 3 is in work position whilst the second screened ink roller 3' is in so-called storage position.

The shaft 5, 5' of each of the two screened ink rollers 3, 3' is driven in rotation by an electronic servo-control motor of brushless type (not shown). Moreover, shaft 5, 5' comprises, towards each of its ends, a toothed wheel 6, 6'. Finally, the ends of said shafts 5, 5' are fast with slide blocks 7, 7'.

Figure 2:
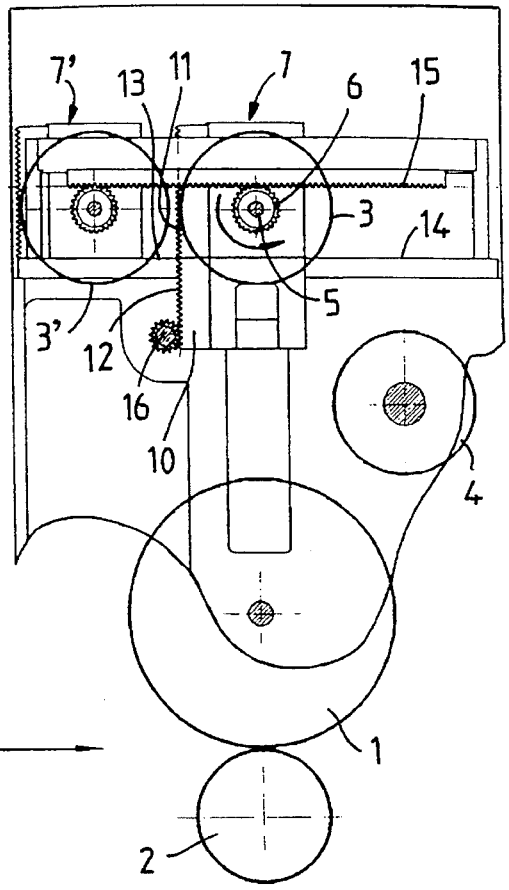
FIGS. 2 to 7 illustrate the different steps effecting the automatic change of said ink rollers according to FIG. 1.

The screened ink roller 3 is automatically changed by a first displacement frown the work position to a second, intermediate position illustrated in FIG. 2. This first displacement, which is linear and vertical, is obtained thanks to slideways 8, 9 which define the path of the slide blocks 7 between the first and the second position.

There is also provided, below each slide block 7, in work position, a transfer piece 10 adapted to move between the two slideways 8, 9, at the same time as the slide blocks 7. This transfer piece 10 is connected to the corresponding slide block 7 so as to allow the vertical displacement of piece 10 by drive of the slide block 7. Such connection may result from the presence of an assembly system of the T-groove type which effects such connection when the displacement is vertical but which must allow disconnection of the slide block 7 and the transfer piece 10 when the displacement is horizontal, as will be explained hereinafter.

The slide block 7 as well as the transfer piece 10 laterally support a rack 11, 12 respectively, the two racks being in line with each other when the slide block 7 and the transfer piece 10 are connected.

The two vertical slideways 8, 9 are each extended, towards their ends opposite the plate cylinder, by a horizontal slideway 13 and 14, respectively. A rack 15 is also disposed, extending horizontally above the two horizontal slideways 13, 14 and the space between these two slideways corresponding to the distance between the two vertical slideways 8, 9.

The printing machine further comprises, opposite each slide block 7, a toothed wheel 16 driven in rotation by a gear motor (not shown). This toothed wheel 16 is disposed so as always to be in mesh on the teeth of the rack 11, 12 either of the slide block 7 or of the transfer piece 10.

The screened ink roller is automatically changed in accordance with the different steps illustrated from FIG. 1 to FIG. 7.

FIG. 1 shows the first screened ink roller 3 in work position, applied against the plate cylinder 1, whilst the second screened ink roller 3' is in position of storage, its slide blocks 7' resting on one of the two horizontal slideways 13, 14 at the end thereof. In this position of storage, which will be referred to as fourth position, the toothed wheel 6' of the second screened ink roller 3' is in mesh on the teeth of the rack 15.

FIG. 2 shows the displacement of the first screened roller 3 from the work position to an intermediate position which will be referred to as second position.

This displacement is obtained by controlling rotation of the gear motor driving the toothed wheel 16 in rotation in the direction of arrow F. The toothed wheel 16 meshing firstly in the rack 11 of the slide block 7 then in the rack 12 of the transfer piece 10, this rotation causes vertical displacement in the direction of arrow G of the assembly constituted by the slide block 7, the first screened roller 3 and the transfer piece 10.

The second position is attained when the toothed wheel 6 borne by shaft 5 of the first screened roller 3 is applied in the teeth of the horizontal rack 15. In this second position, the base of the slide block 7 is tangential to the upper face of the horizontal slideways 13, 14.

Figure 3:
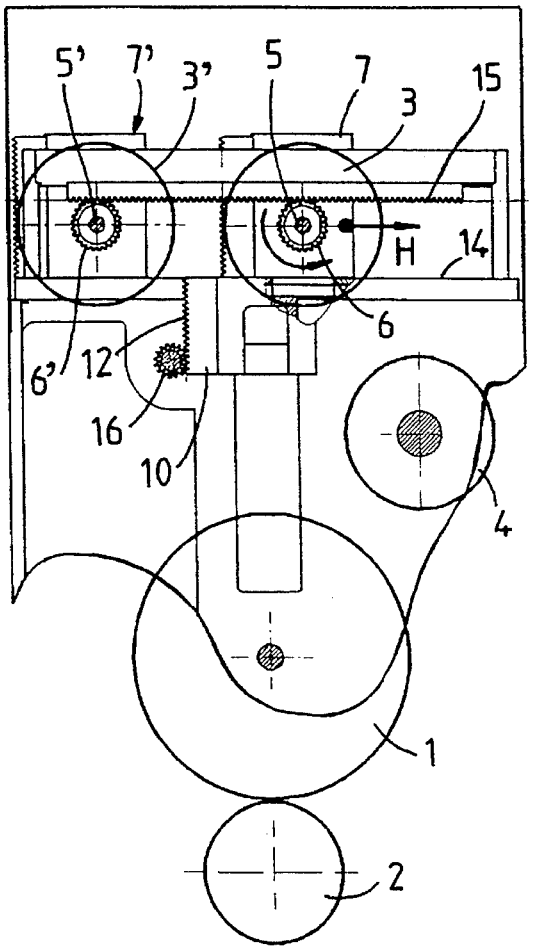

FIG. 3 shows the second displacement of the first screened ink roller 3 from the second to the third position, this latter corresponding to the position of storage of the first screened roller. This displacement is obtained by controlling said electronic servo-control motor for driving the shaft 5 of the first screened roller 3, in the direction of arrow F. The toothed wheel 6 meshing on the horizontal rack 15, this rotation drives the assembly constituted by the slide block 7 and the first screened roller 3 in the direction of arrow H. During this displacement, the base of the slide block 7 abuts and slides on the surface of the horizontal slideway 14.

During this displacement, the transfer piece 10 remains in the position it occupied in FIG. 2, i.e. when the first screened ink roller was in the second position. In fact, the slide block 7 is disconnected from the transfer piece 10, by slide with respect to one another of the assembly system of the T-groove type.

Figure 4:
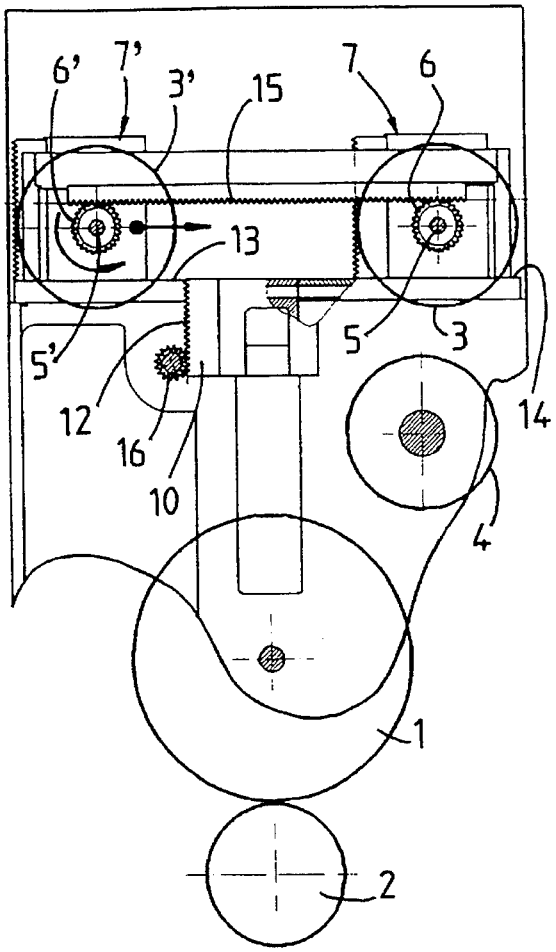

FIG. 4 shows the two screened ink rollers 3, 3' in position of storage.

Figure 5:
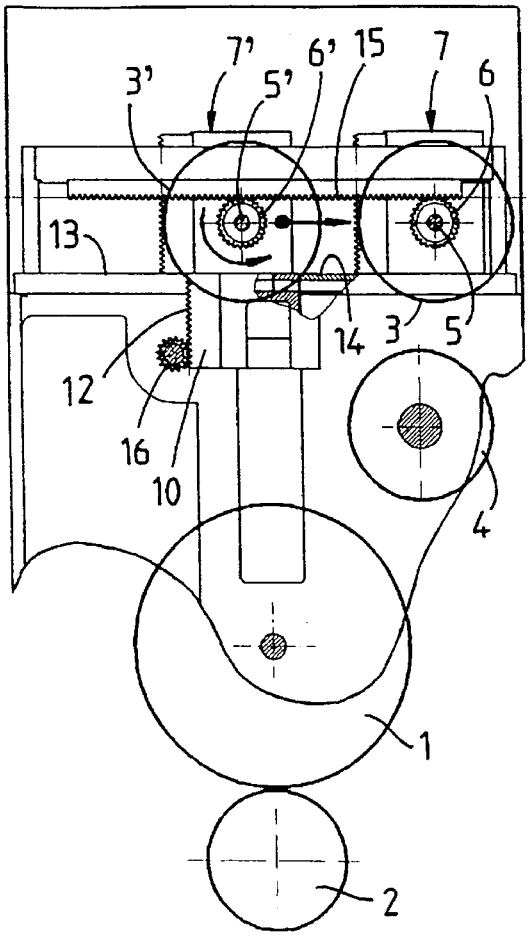
Figure 6:
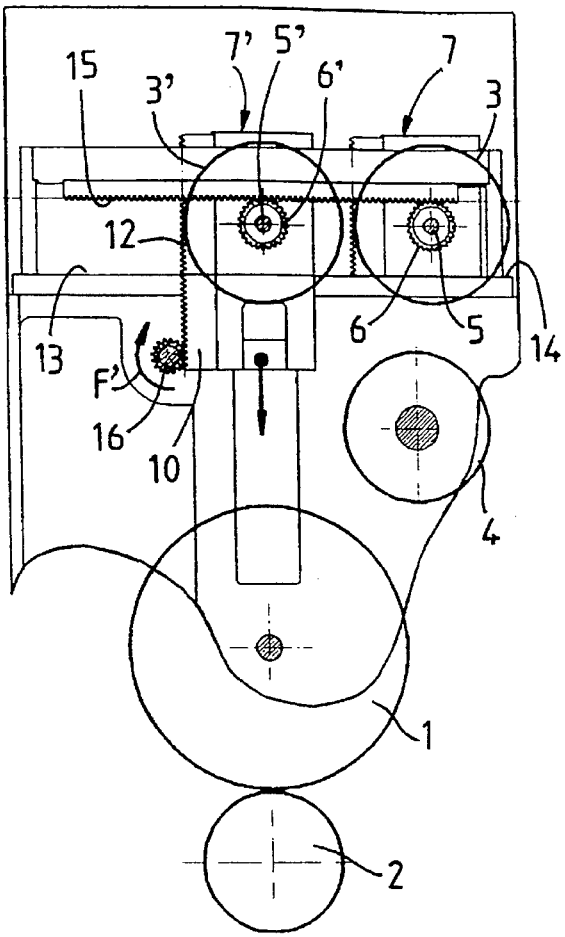
Figure 7:
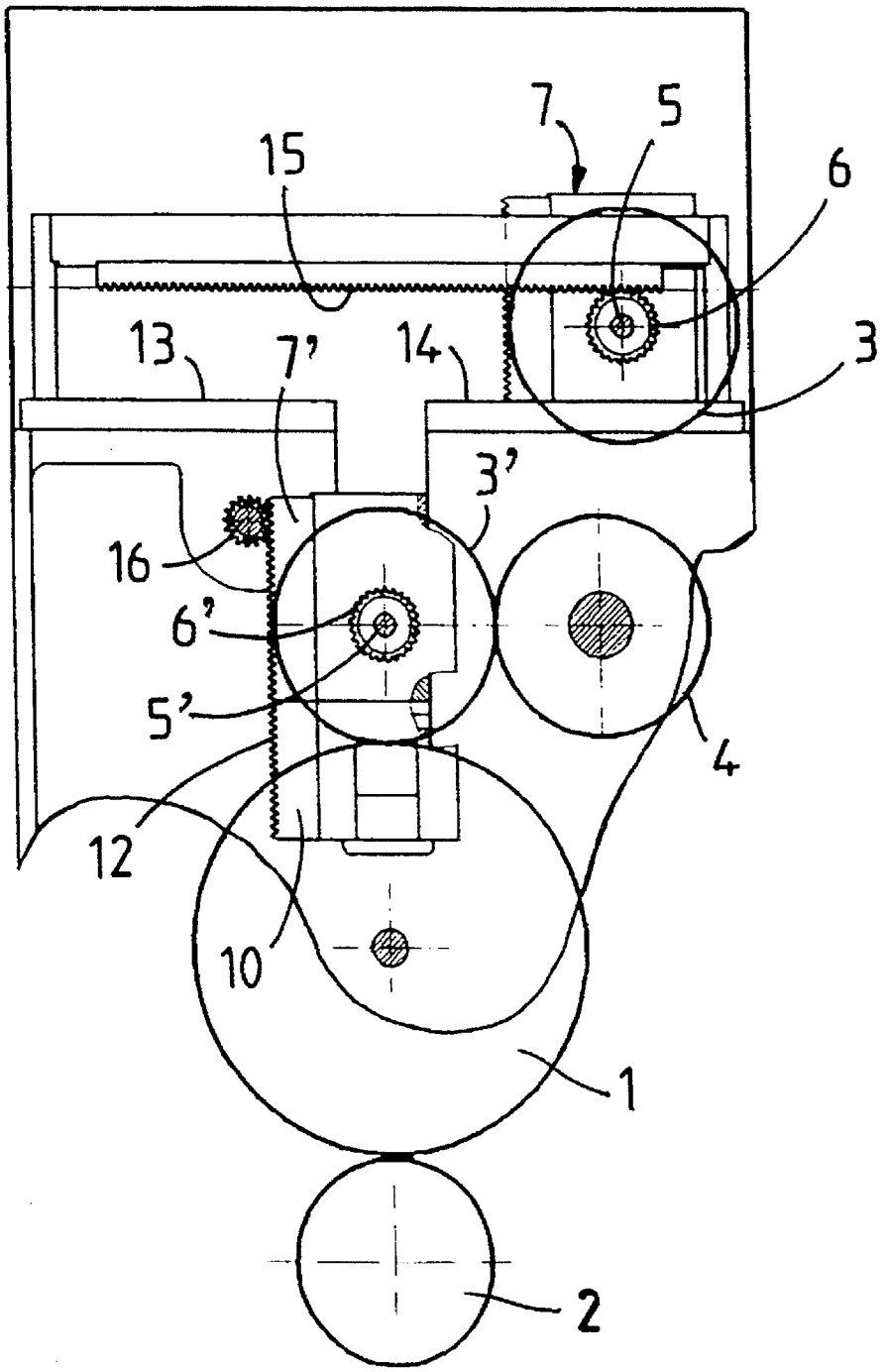

FIGS. 5 to 7 show the steps effecting displacement of the second screened ink roller 3' from its position of storage to the work position. These steps are similar to those which have just been describe.

The displacement of the second screened ink roller 3' from the fourth to the second position is effected by rotation of the electronic servo-control motor driving the toothed wheel 6' mounted on the shaft 5' of said second screened ink roller 3' in the direction of arrow F. During this displacement, the slide block 7' of the second screened roller 3' is connected with the transfer piece 10 which had remained in the same position.

When this second screened ink roller 3' is in the second position, as illustrated in FIG. 6, the gear motor drives in the direction of arrow F' the toothed wheel 16 which firstly meshes in the rack 12 of the transfer piece 10 then in the rack 11' of the slide block 7', so as to drive the second screened ink roller 3' from the second to the first position.

As may be seen in FIG. 7, the second screened ink roller 3' which was initially in the fourth position of storage, has passed into work position, whilst the first screened ink roller 3 which was in work position has been placed in the third position of storage.

The embodiment which has just been described was done so by way of non-limiting example. It is question of a particularly simplified embodiment since it comprises only two screened ink rollers 3, 3'. It would be possible to envisage a plurality of screened ink rollers in storage position. In that case, it would be necessary to extend the horizontal slideways 13 and 14 in order to allow juxtaposition of a plurality of rollers on the same horizontal slideway 13 or 14.

It will, of course, be understood that the drive motors of the screened ink rollers 3, 3' and of the toothed wheel 16 are connected to an electronic control system making it possible to synchronize the displacements as described hereinabove. More particularly, a particular synchronization must be effected so that, upon arrival of the roller in the second position, the corresponding toothed wheel 6 comes perfectly into mesh in the teeth of the rack 15.

Moreover, in the case of more than two screened ink rollers, it would be necessary to ensure that the storage of the screened ink rollers on the horizontal slideways 13, 14 is always effected in the same order, in order to avoid the connecting cables of the drive motors of the screened rollers entangling. Such storage may be obtained by displacing one screened ink roller from one horizontal slideway 13 to the other 14 by using, as displacement base, the upper face of the slide block 7 of a screened ink roller on standby, said face being in line with the two horizontal slideways 13, 14.

In the second embodiment, illustrated in FIG. 8 to 12, the printing machine incorporates automatic washing of the plate cylinder 1 and retraction of the assembly 17 constituted by the impression cylinder 2 and the sheet transfer system.

The plate cylinder 1 is generally washed manually when the machine is stopped, or the plate cylinder 1 is dismantled and placed in a special washing installation.

Thanks to the system of double-displacement cylinder according to the invention, it becomes possible to ensure automatic washing of the plate cylinder 1, after complete retraction of the impression cylinder 2.

In the embodiment which will be described hereinafter, the impression cylinder 2 is fast with the system for transferring the material to be printed. There is therefore a transfer assembly 17 which is constituted by the impression cylinder 2, the electronically servo-controlled motor 18 which drives the shaft 19 of the impression cylinder 2, a set of belts 20, possibly notched, mounted in a loop around two drive rollers 21, 22, roller 22, located near the impression cylinder 2, also being driven by motor 18. The set of belts 20 may be replaced by a succession of drive rollers.

Figure 8:
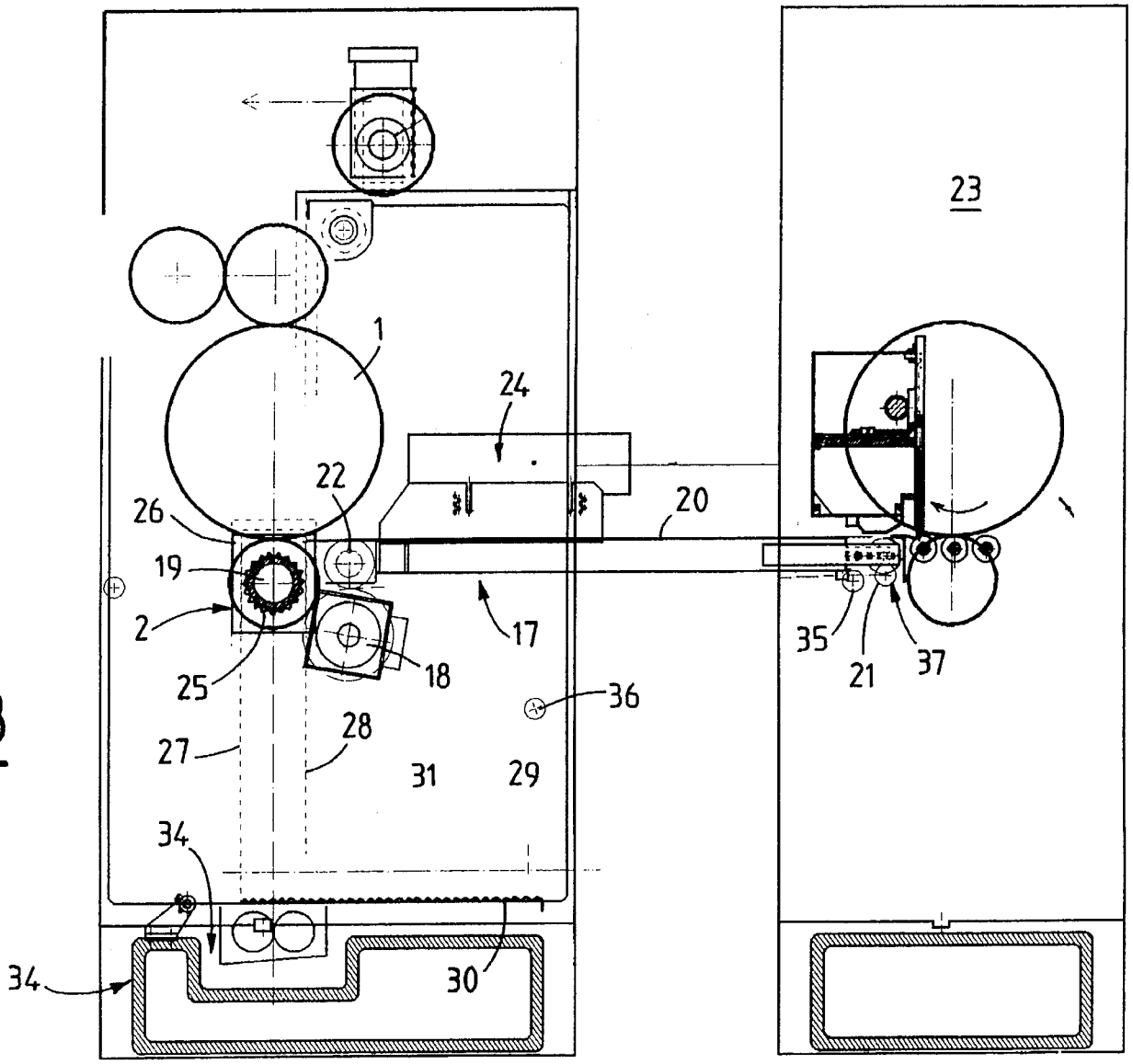
FIG. 8 is a side view of the machine with automatic washing of the plate cylinder and with retraction of the impression cylinder/transfer system assembly, the mobile device being in standby position.

As may be seen in FIG. 8, the set of belts 20 conveys the printed material, sheet by sheet, from the preceding station 23.

The set of belts 20 may possibly be surmounted by an infrared device 24 intended for drying the ink in the event of the preceding station 23 itself being a printing station.

According to the invention, the shaft 19 of the impression cylinder 2 supports at each of its ends, on the one hand, a toothed wheel 25 and, on the other hand, a slide block 26 which, in the present case, is a rectangular metal plate.

Retraction of the impression cylinder 2 is effected by a first vertical displacement, thanks to vertical slideways 27, 28 defining the path of the slide block 26 between the first work position of the impression cylinder 2 and the second, intermediate position. A second displacement, between said second position and a third storage position is effected thanks to two horizontal slideways 29, 30 defining the path of the slide block 26 between these two positions.

Drive of the impression cylinder 2 in the course of the first displacement, and correlatively of the transfer assembly 17, is obtained thanks to a system of ballscrews, driven by motor, the nut of the ballscrew supporting the slide block 26 between the first and the second position. The slide block 26 is preferably provided with a notch in which penetrates the nut of the ballscrew during this displacement so as to ensure blockage thereof. The arrangement of the notch is such that, when the slide block is driven from the second towards the third position, the nut of the ballscrew leaves the notch, disconnecting the transfer system 17 from the ballscrew system.

The machine is also equipped with horizontal racks 31, located in the zone between the two horizontal slideways 29 and 30.

The mobile washing device 32 is constituted by a tank 33 for recovering the washing liquid and by an assembly comprising rotating brushes with axial displacement and jets of water. Of course, this mobile washing device 32 may be equipped with any mechanical, pneumatic, ultrasonic . . . means for washing the plate cylinder 1 in a short period of time.

When the impression cylinder 2 is in the first work position, the mobile washing device 32 is located in a housing 33 which is a hollowed out part of the base 34 of the machine.

Vertical displacement of the washing device 32 from its housing 33 up to the first position, i.e. in the immediate vicinity of the plate cylinder 1, is preferably obtained thanks to the same means as those ensuring vertical displacement of the impression cylinder 2.

To that end, the washing device 32 is equipped, at each of its ends, with a slide block (not shown) adapted to move, like the slide block 26 of the impression cylinder 2, between the vertical slideways 27, 28 to effect automatic washing of the plate cylinder 1.

In the embodiment where the impression cylinder 2 is fast with the transfer assembly 17, retraction of the set of belts 20 is obtained likewise thanks to two abutment rods 35, 36 whose position and role will be explained in the following description of the different steps allowing complete retraction of the transfer system 17 and the automatic installation of the washing device 32.

FIG. 8 shows the transfer system 17 in its work position, namely the impression cylinder 2 being applied on the plate cylinder 1 and the set of belts 20 being upstream and in horizontal line with the line of tangency between the plate cylinder 1 and the impression cylinder 2.

In order that the set of belts 20 is not totally in overhang with respect to the ballscrew system which maintains this assembly 17 in position, support rods or rollers 37 have been disposed at the preceding station 23.

Figure 9:
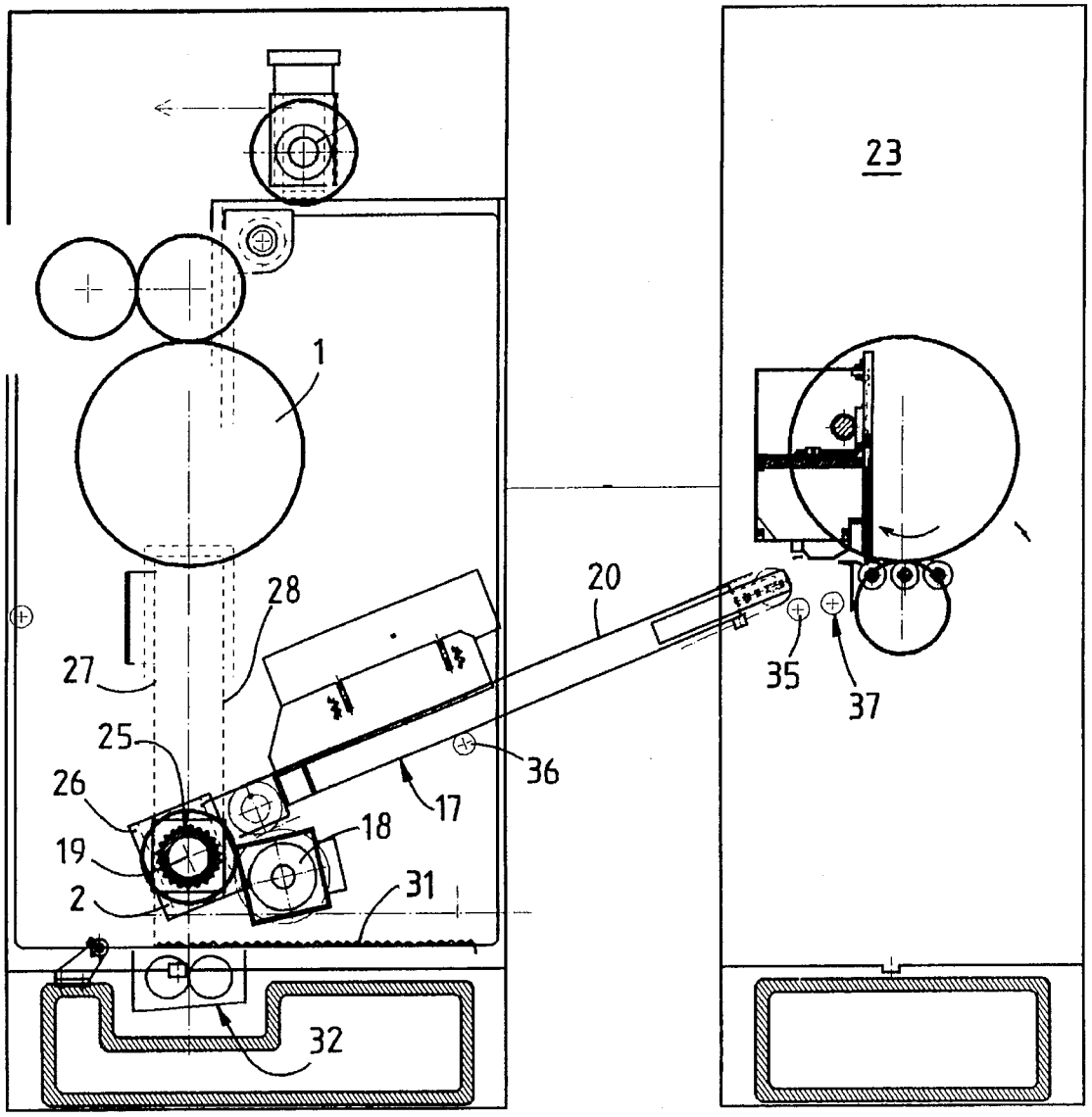
FIGS. 9 to 12 show the different steps for positioning the washing device and device for retraction of the impression cylinder/transfer system assembly.

FIG. 9 shows the first displacement of the impression cylinder 2 from the first work position towards the second position, obtained thanks to the rotation of the screw of the ballscrew system and the correlative displacement of the slide blocks 26 between the slideways 27, 28.

During the first part of this displacement, the upstream end of the set of belts 20 was supported by an abutment rod 35 placed on the frame of the preceding station 23.

In the second part of this same displacement, the belt 20 is supported by a second abutment rod 36 fixed to the frame of the printing machine.

Figure 10:
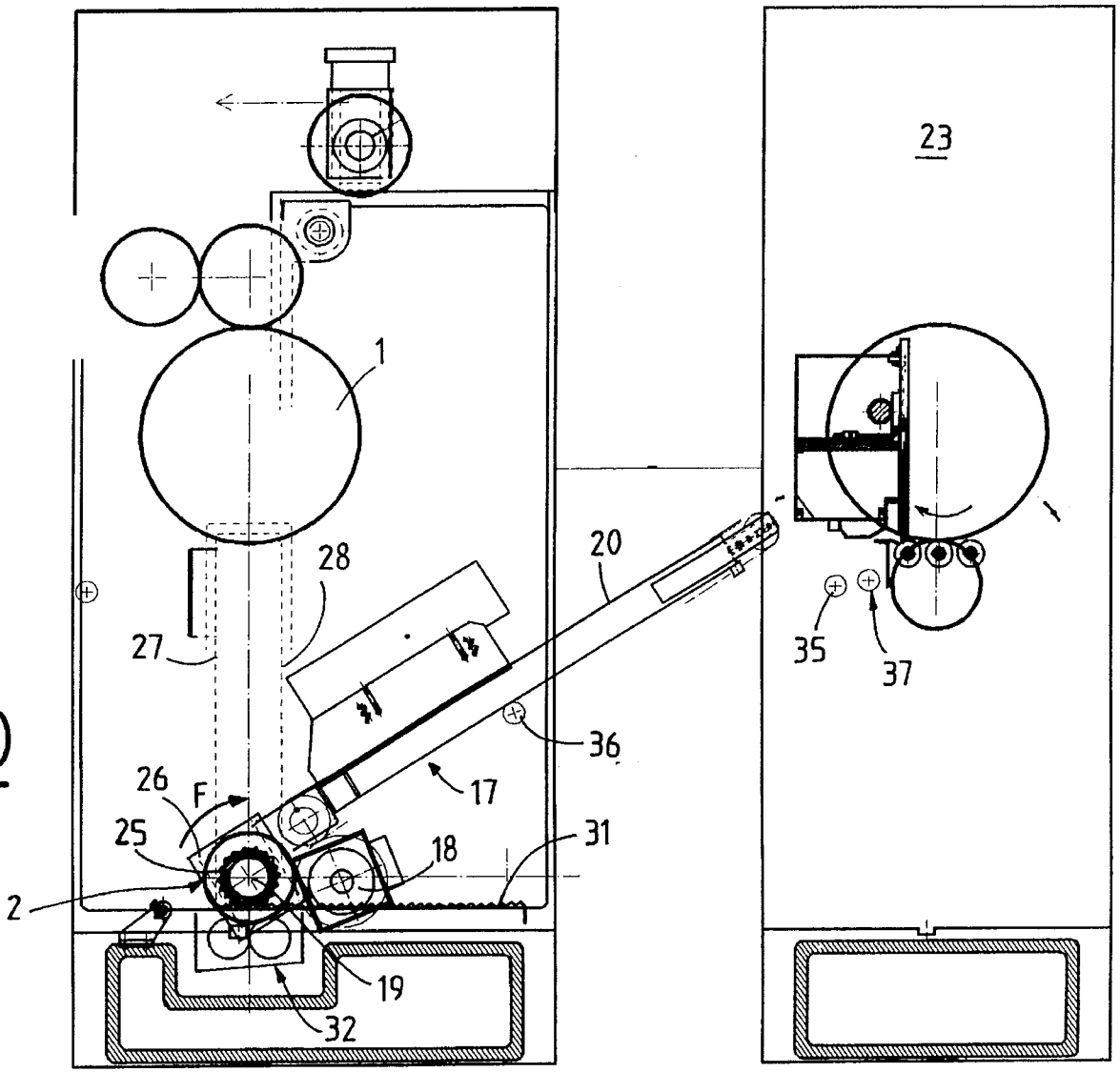

In this way, when the impression cylinder 2 attains the second position as illustrated in FIG. 10, the set of belts 20 makes substantially an angle of 45° with respect to the horizontal.

Complete retraction of the transfer system 17 is effected thanks to the second displacement of the impression cylinder 2 between the second intermediate position and the third standby position.

This second displacement is obtained thanks to the rotation of the shaft 19, driven by the electronic servo-control motor 18.

Upon arrival of the impression cylinder 2 in the second position, the toothed wheel 25 meshes on the teeth of the horizontal rack 31. In this way, during rotation of the shaft 19 in the direction of arrow F, the toothed wheel 25 meshes on the rack 31 and moves thereon to the end position corresponding to the standby position.

Figure 11:
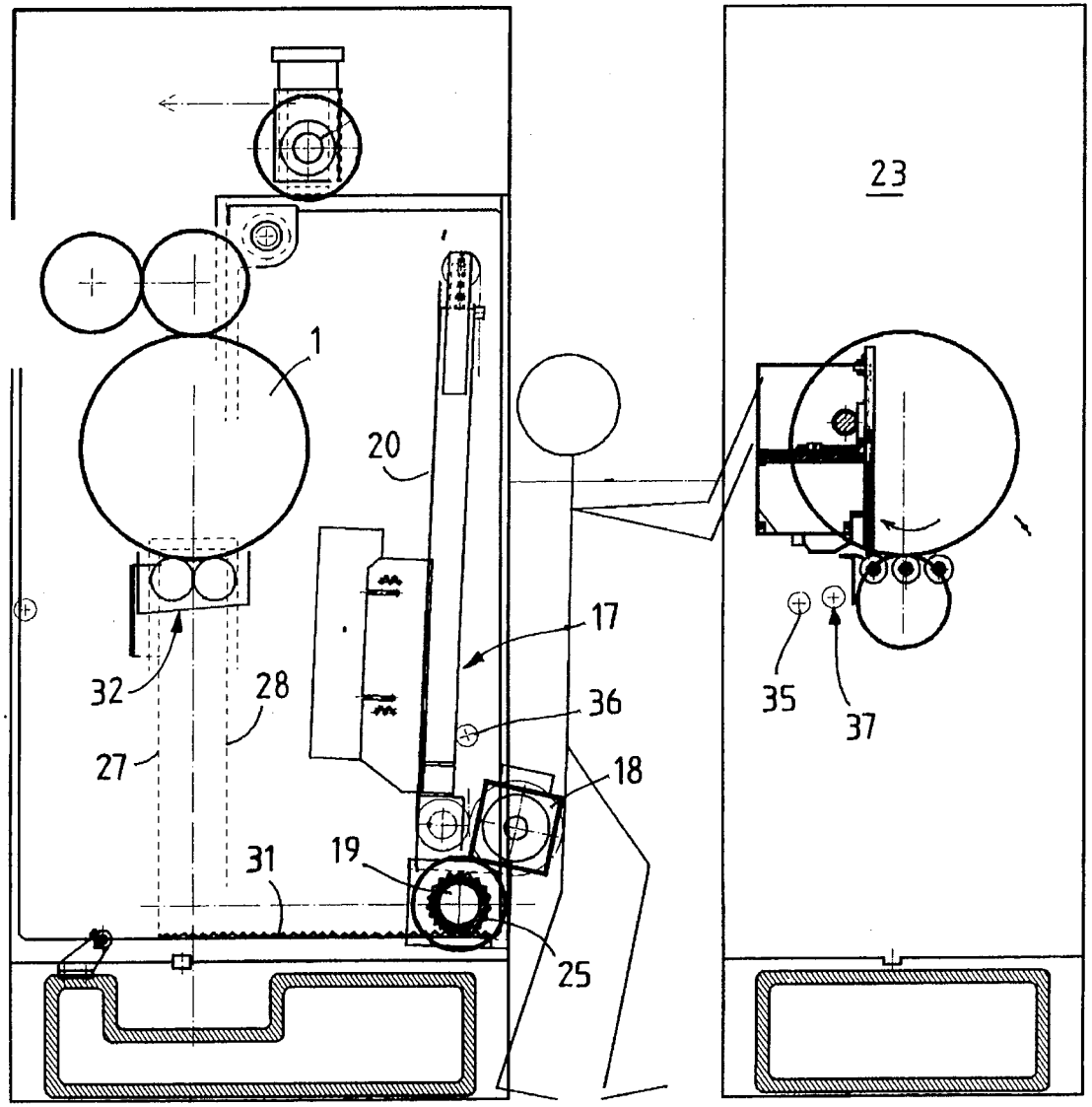

During this horizontal displacement, the set of belts 20 remained in abutment on the rod 36, which caused a pivoting of the transfer system 17, so that the Set of belts 20 is almost in vertical position when the impression cylinder 2 is in the third standby position, as shown in FIG. 11.

Once this second displacement is effected, or possibly in masked time, vertical displacement of the washing device is effected between its base position where it is in its housing 33, up to its upper position where it is near the plate cylinder 1.

Such a displacement may be obtained by independent means, or preferably by the same means as those employed for ensuring the first vertical displacement of the impression cylinder 2.

Being question of the ballscrew system, in a first embodiment, the washing device 32 comprises a fork which is retractable between a retracted position and an extended position in which the ballscrew penetrates between the prongs of the fork above the nut of the ballscrew, the passage between the retracted position and the extended position of the fork being effected under the action of an end-of-stroke contactor upon arrival of the impression cylinder 2 in the third standby position.

Figure 12:
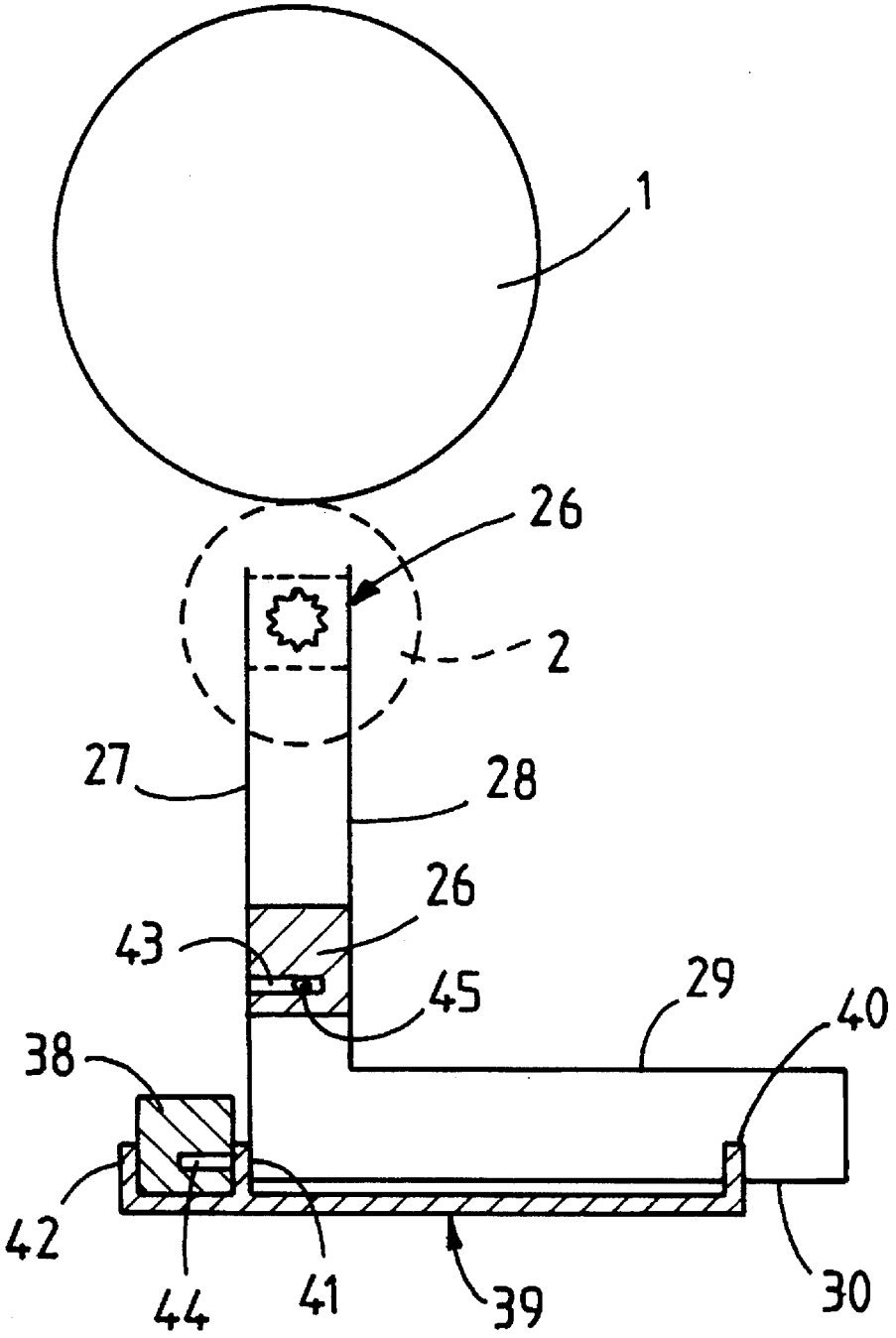

In a second embodiment illustrated in FIG. 12, the washing device 32 is mounted at each of its ends on slide blocks 38 and the machine also comprises a set of mobile pieces 39. As is apparent in FIG. 12, the mobile piece 39 is located beneath the level of the lower horizontal slideway 30. Furthermore, it is characterized by three shoulders 40, 41, 42, the first 40 being located at its front end whilst the other two shoulders 41, 42 are located at its rear end and define therebetween a space adapted to form a housing for the slide block 38 of the washing device 32.

FIG. 12 shows the position taken by the mobile piece 39 whilst the transfer system 17 is in work position.

Upon the first displacement, and for the major part of the second displacement, the mobile piece 39 remains in this same position.

At the end of the second displacement, the slide block 26 supporting the impression cylinder 2 abuts on the first shoulder 40 and pushes it with it up to the third, standby position. Correlatively, this brings about the displacement of the mobile piece 39. The amplitude of the displacement of this piece 39 and therefore the position of the first shoulder 40 with respect to the third standby position, is determined so that, when said shoulder 40 is in this third position, the slide block 38 of the washing device 32 is located plumb with the vertical slideways 27, 28.

Each slide block 26 of the impression cylinder 2 comprises a substantially horizontal notch 43, open on the left-hand side in FIG. 12. Each slide block 38 of the washing device 32 comprises a substantially horizontal notch 44, open on the right-hand side. Upon the first vertical displacement from the first position to the second position, the nut of the ballscrew 45 of the ballscrew system is in the notches 43 of the slide blocks 26 and supports the impression cylinder 2. Upon the second, horizontal displacement of the slide blocks 26 from the second towards the third position, the nut of the ballscrew 45 remains in place, emerging from the notch 43. When the slide blocks 38 of the washing device 32 move towards the right, towards the perpendicular of the vertical slideways 27, 28, the nut of the ballscrew 45 penetrates in the notch 44. The ballscrew system may then drive the washing device 32 from the second to the first position.

What is claimed is:

1. A printing machine comprising at least one cylinder with double displacement, first means for displacement of said cylinder from a first position corresponding to a work position to a second position, second means for displacement of said cylinder from said second position to a third position, and an individual drive motor and toothed wheels provided at both ends of a cylinder shaft of said double-displacement cylinder, wherein the second displacement means comprise a set of two racks in which the toothed wheels are able to mesh so that the displacement of said cylinder from the second position to the third position is obtained in response to the rotation of the drive motor of the cylinder shaft.

2. The printing machine of claim 1, wherein each end of the cylinder shaft is provided with a slide block, the first displacement means comprise a first set of two slideways defining the path of said slide blocks between the first and the second positions and said first displacement means are adapted simultaneously to displace said two slide blocks in said slideways.

3. The printing machine of claim 2, wherein each slide block comprises a rack, and the first displacement means comprise a motor driving a pinion adapted to mesh on said rack.

4. The printing machine of claim 2, wherein each slide block comprises a notch, and the first displacement means comprise a motor driving two vertical ballscrews, each ballscrew having a nut with said nut of each ballscrew supporting a respective slide block between the first and the second positions, and each said nut being automatically disengageable from each slide block between the second and the third positions.

5. The printing machine of claim 3, comprising at least two cylinders with double displacement which are screened ink rollers, one of said screened ink rollers being in a fourth, so-called storage position, while the other is in the first work position, and third means for displacement of said one screened ink roller from the fourth position to the second position, said displacement being in the same direction as that of the displacement of the other screened ink roller from the second position to the third position, said screened ink rollers being subject to automatic change effected by actuating the first, second and third displacement means so that the roller which is in the first work position passes to the second then to the third position and the roller which is in the fourth storage position passes to the second then to the first work position.

6. The printing machine of claim 5, comprising a plate cylinder, wherein, as the screened ink roller is placed above the plate cylinder, the displacement of said roller from the first to the second position is vertical, and the third displacement means comprise a set of racks in which the toothed wheels of said screened ink roller are able to mesh so that said one screened ink roller can be displaced from the fourth position to the second position, and wherein a second and a third set of horizontal slideways extend respectively between the second and the fourth positions and between the second and the third positions, and two transfer pieces, with rack, are arranged so that the two transfer pieces support the slide blocks of the screened ink roller in the first work position and the displacement of said roller from the first to the second position is effected by drive of the pinion meshed on the racks of the slide block then on the transfer piece, and the displacement of the roller from the second to the third position or from the fourth to the second position is effected by drive of the toothed wheels of the roller meshed on said set of racks and by slide of the slide blocks on the second or the third set of horizontal slideways.

7. The printing machine of claim 6, wherein one of screened ink rollers is able to pass from the third position to the fourth storage position by displacement on the horizontal slideways and on an upper face of the slide blocks of another screened ink roller which is in a standby position, said upper face being in line with the horizontal slideways.

8. The printing machine of claim 4, wherein said at least one cylinder with double-displacement is an impression cylinder placed in the first work position beneath a plate cylinder, and said printing machine further comprises a mobile device for washing the plate cylinder and means for displacing said washing device near the plate cylinder when the impression cylinder has passed from the first to the third position.

9. The printing machine of claim 8, wherein the displacement from the first to the second position of the impression cylinder is substantially vertical, and when the impression cylinder is in the first work position, the mobile washing device is placed in a housing which is located near the second position, and the means for displacement of said washing device comprise the first means for displacement of the impression cylinder.

10. The printing machine of claim 9, wherein the means for displacement of the washing device comprise a fork which is fastened with said washing device and which is retractable between a retracted position and an extended position in which the ballscrew penetrates between the prongs of the fork above the nut of the ballscrew, passing of the washing device between the retracted position and the extended position of the fork being effected by an end-of-stroke contractor when the impression cylinder arrives in the third position and contacts with said contactor.

11. The printing machine of claim 9, wherein the displacing means of the washing device comprise slide blocks provided with a notch and a mobile piece with three shoulders arranged thereon so that, when the impression cylinder is displaced from the second to the third position, the slide block of the impression cylinder pushes the first shoulder of the displacing means of the washing device and said slide block drives the mobile piece thereof such that one of the slide blocks of the impression cylinder is housed between the other two shoulders and is located plumb with the two vertical slideways, each of the nuts of the ballscrews penetrating in the notch of the displacement means of the washing device.

12. The printing machine of claim 1, wherein said at least one cylinder with double-displacement is an impression cylinder, and said printing machine further comprises a system for transferring material to be printed which rigidly fastened with the impression cylinder, and abutment rods on which the transferring system abuts and pivots on itself upon passage of the impression cylinder from the first to the third position.

13. The printing machine of claim 12, wherein the transferring system has a substantially horizontal direction when the impression cylinder is in the first work position, and the abutment rods are disposed so that the transferring system has a substantially vertical direction when the impression cylinder is in the third position.

14. The printing machine of claim 1, comprising at least two cylinders with double displacement which are screened ink rollers, one of said screened ink rollers being in a fourth, so-called storage position, while the other is in the first work position, and third means for displacement of said one screened ink roller from the fourth position to the second position, said displacement being in the same direction as that of the displacement of the other screened ink roller from the second position to the third position, said screened ink rollers being subject to automatic change effected by actuating the first, second and third displacement means so that the roller which is in the first work position passes to the second then to the third position and the roller which is in the fourth storage position passes to the second then to the first work position.

15. The printing machine of claim 1 wherein said at least one cylinder with double-displacement is an impression cylinder placed in the first work position beneath a plate cylinder, and said printing machine further comprises a mobile device for washing the plate cylinder and means for displacing said washing device near the plate cylinder when the impression cylinder has passed from the first to the third position.

* * * * *